United States Patent [19]

Winegeart et al.

[11] 4,456,217

[45] Jun. 26, 1984

[54] KELLY VALVING APPARATUS

[75] Inventors: Mitchell E. Winegeart; Lawrence Connelly, both of Metairie, La.

[73] Assignee: Pet Tech-Dril Saf, Inc., Houston, Tex.

[21] Appl. No.: 335,327

[22] Filed: Dec. 29, 1981

Related U.S. Application Data

[63] Continuation-in-part of Ser. No. 87,732, Oct. 20, 1979, abandoned.

[51] Int. Cl.[3] ..... F16K 31/122

[52] U.S. Cl. ..... 251/58; 92/13.6; 92/68; 92/106; 166/319; 175/318; 251/229; 251/250

[58] Field of Search ..... 74/25, 29, 30; 92/13, 92/13.3, 13.8, 106, 136, 138, 68, 60.5; 166/319; 175/318; 251/58, 229, 250

[56] References Cited

U.S. PATENT DOCUMENTS

| | | | |
|---|---|---|---|
| 2,536,565 | 1/1951 | Ostergren | 92/106 |
| 2,643,677 | 6/1953 | MacLean | 251/58 |
| 2,835,227 | 5/1958 | Gamet | 92/106 |
| 3,104,862 | 9/1963 | Pearson et al. | 251/58 |
| 3,204,920 | 9/1965 | Generke | 251/58 |
| 3,439,925 | 4/1969 | Sampson | 92/106 |
| 3,806,082 | 4/1975 | Kellner | 251/58 |
| 3,887,161 | 6/1975 | Kubelka, Jr. | 251/58 |
| 3,941,348 | 3/1976 | Mott | 251/58 |

*Primary Examiner*—George L. Walton
*Attorney, Agent, or Firm*—Charles C. Garvey

[57] ABSTRACT

A kelly valving apparatus for controlling flow of fluid through a kelly and drill string comprises a rotatable tubular section having a fluid conveying bore adapted to be attached to the drill string at the kelly with a valve associated valve body valving the flow of fluids through the bore. A remotely operable operator is rotatable with the rotatable tubular section, operably engaging the valve for moving the valve between positions which open and close the bore, the operator including at least one hydraulic cylinder having an extensible ram actuated by hydraulic fluid, and linkage is connected to the valve and the hydraulic cylinder so that extension/contraction of the ram effects an opening or closure of the bore. A liquid interface fluid collector ring is positioned adjacent the rotatable tubular section for transmitting pressurized hydraulic fluid to the hydraulic cylinder, even during spinning of the cylinder with the tubular section. A source of controllable pressurized hydraulic fluid is connectable to the fluid collector ring for supplying pressurized hydraulic fluid thereto.

10 Claims, 21 Drawing Figures

KELLY VALVING APPARATUS

This application is a continuation-in-part of Ser. No. 087,732, filed Oct. 24, 1979 now abandoned.

TECHNICAL FIELD

The present invention relates to closure devices and valving devices for oil field kellys. Even more particularly, the present invention relates to a remotely operable kelly cock which closes flow of fluid through the kelly even while the kelly is in a spinning operative position by using, preferably hydraulic power through a liquid interface.

Background Art

In the oil field, it is known to use a kelly having an inner flow conveying bore which is operated by a rotary table in drilling for oil or gas with the kelly applying the necessary rotational force to the drill string and its attached drill bit. The kelly forms a portion of the conduit through which fluids (such as drilling mud and additives) flow from the surface to the drill bit area. The kelly thus spins during the drilling operation.

During the drilling process, unsafe conditions can arise as in the case of a blowout in which situation it is desirable that the kelly be closed and the flow of fluid through its inner provided bore valved to a shut or closed position. Failure to close the bore allows formation pressures to force oil/gas, drillings fluids and the like back up the well bore to the surface where explosion or fire can result. The national news media has frequently covered scenes of offshore drilling rigs uncontrollably ablaze after a blowout. Such disaster is frequently accompanied by loss of life and by significant loss of property. Often environmental destruction is produced as oil is thrust into the surrounding waters of an offshore rig creating a "slick" which can extend for miles polluting water and beaches.

Valving devices to solve these problems by closing the kelly bore are known in the art as "kelly cocks. These kelly cocks can close the kelly bore usually only when the kelly is not spinning. The are for the most part manually operated.

Such devices usually require that the kelly be stopped before closure can be effected, and an operator climb up and shut the device. Manual type kelly cocks are known which require manual operation by means of a hand operable tool such as an allen wrench or the like. These types of kelly cocks are known in the art and available from a variety of manufacturers. See, for example, the kelly cock safety valve as manufactured by Hydril.

U.S. Pat. No. 1,494,764 issued to J. McDonald Wishart discloses an "Adjustable Stroke Compressor".

In U.S. Pat. No. 1,780,329 issued to F. N. Bard there is seen the patent entitled "Reversing Gear Mechanism" which relates in general to reversing gear mechanism and more particularly to mechanism of the character referred to operable by mechanical power, and has special reference to the provision of an improved form of fluid pressure driven reversing gear mechanism.

A "Servomotor" is seen in U.S. Pat. No. 2,536,565 issued to G. Ostergren which patent relates to a servomotor and more particularly to a reciprocating hydraulic servomotor for actuating the blades of a propeller.

U.S. Pat. No. 2,847,868 discloses "Hydraulic Steering Gear with a Gear Rack Disposed Intermediate Piston Heads" which issued to P. A. Newman.

A "Discharge Valve Mechanism" is disclosed in U.S. Pat. No. 3,104,862 issued to B. A. Pearson, et al, which relates to discharge valve mechanism, and particularly discharge valve mechanism capable of passing solid objects and which can be operated by remote means.

U.S. Pat. No. 3,146,681 entitled "Plug Valve Operator" issued to J. M. Sheesley relates to an apparatus for hydraulic or pneumatic operation of valves, particularly plug valves, or other valves which require only a relatively small movement to be operated from fully open to fully closed.

A "Fluid Motor Actuator" issued to J. T. Looney is seen in U.S. Pat. No. 3,148,595 which discloses a fluid motor actuator by which linear motion is converted to rotary motion. More specifically the invention relates to the specific construction of a fluid motor actuator which is especially adapted for rotating a shaft back and forth between predetermined adjustable limits in each direction.

U.S. Pat. No. 3,338,140 issued to J. M. Sheesley entitled "Actuator" relates to fluid operated means for converting longitudinal movement to rotary movement, and more particularly it relates to improvements in fluid operated actuators for actuating plug valves and the like.

U.S. Pat. No. 3,982,725 entitled "Valve Actuator" issued to Clark discloses a low profile fluid powered actuator particularly for valves of the type in which the valve element is rotated to open and close the flow passageway through the valve body, the actuator having a novel internal porting system, means for direct attachment of the valve stem to the shaft of the actuator, and a novel manual override for manually operating the valve.

U.S. Pat. No. 3,806,082 entitled "Power Kelly Cock" discloses a mechanical-type transmission for powering a kelly cock to close off the drilling kelly during operation.

U.S. Pat. No. 3,941,348 issued to James Mott and entitled "Safety Valve" provides a remotely operable safety valve mounted between the swivel and the kelly during drilling operations including a spherical shaped valve element which is mounted in a tubular housing rototable with the swivel sub, the kelly and the drill string. The valve is moved between open and closed positions in order to control flow through the drill string and prevent end line blowouts. As an additional safety feature, a spring means moves the valve element to a closed position in the event of a failure of the hydraulic means.

In U.S. Pat. No. 3,887,161 there is provided "An Arrangement for Closing a Kelly Cock Supported on a Rotary Swivel with a Stem Therefrom".

It would be desirable to provide a remotely operable kelly cock or a kelly valve apparatus which would function in both static and spinning conditions. Such a valve or kelly cock apparatus would be operable while the kelly is still spinning or stopped and would be preferably automatically operable from a remote location.

In blowout conditions, it is not always possible to close the kelly manually since danger exists, and the oil rig workers can panic and retreat from the drilling area.

The present invention solves these prior art problems in a simple, inexpensive and straightforward manner by providing an automatic remotely operable (as well as manually operable) kelly valving apparatus which can be opened or closed in either a static or spinning condition of the kelly. A hydraulic operator is provided with a liquid interface through which hydraulic fluid flows to the operator even when the kelly is spinning.

DISCLOSURE OF INVENTION

The present invention provides a kelly cock apparatus which is both automatic and manual in operation being operable from a remote location if desirable. The apparatus provides attached to the well drilling kelly a valve structure having an associated operator. A hydraulic driving fluid powers the operator between open and closed flow positions.

In order that operation of the operator can be maintained in both spinning and static condition of the kelly, a driving fluid flows to operate the valve and the valve structure itself. In the preferred embodiment, the fluid interface is in a form of an annular collecting ring which provides at least one annular groove filled with fluid and connected to the operator for applying driving force thereto. The operator in the preferred embodiment could be, for example, hydraulic, having a drive arm mounted for rotation with the valving member and powered by a pair of hydraulically operated cylinders, with one cylinder moving the drive arm to open the valve while the other cylinder closes the valve.

Therefore, it is an object of the present invention to provide a kelly valve apparatus which is operable in both static and spinning positions of the kelly.

It is the further object of the present invention to provide a kelly cock or valving apparatus which is both manually and automatically operable.

Still another object of the present invention is to provide a kelly cock or valve apparatus which is remotely operable and manually operable at the valve itself.

It is another object of the present invention to provide a remotely operable kelly cock valve apparatus which can be added to existing manually operable kelly cock devices.

It is another object of the present invention to provide a supplementary kelly cock operator which is attached to manual type kelly cocks and transforms them from manual to automatic operation.

Another object of the present invention is to provide a remotely operable kelly valving apparatus which is safe and easy to operate.

Another object of the present invention is to provide a kelly valving system having indications to the driller as to the position of the kelly valving member portion thereof.

Another object of the present invention is to provide an entirely hydraulic kelly closure apparatus, remotely operable, in either static or opening positions of the kelly.

BRIEF DESCRIPTION OF THE DRAWINGS

For a further understanding of the nature and objects of the present invention, reference should be had to the following detailed description taken in conjunction with the accompanying drawings in which like parts are given like reference numerals and wherein.

DETAILED DESCRIPTION OF THE PREFERRED EMBODIMENT

Figure 1:
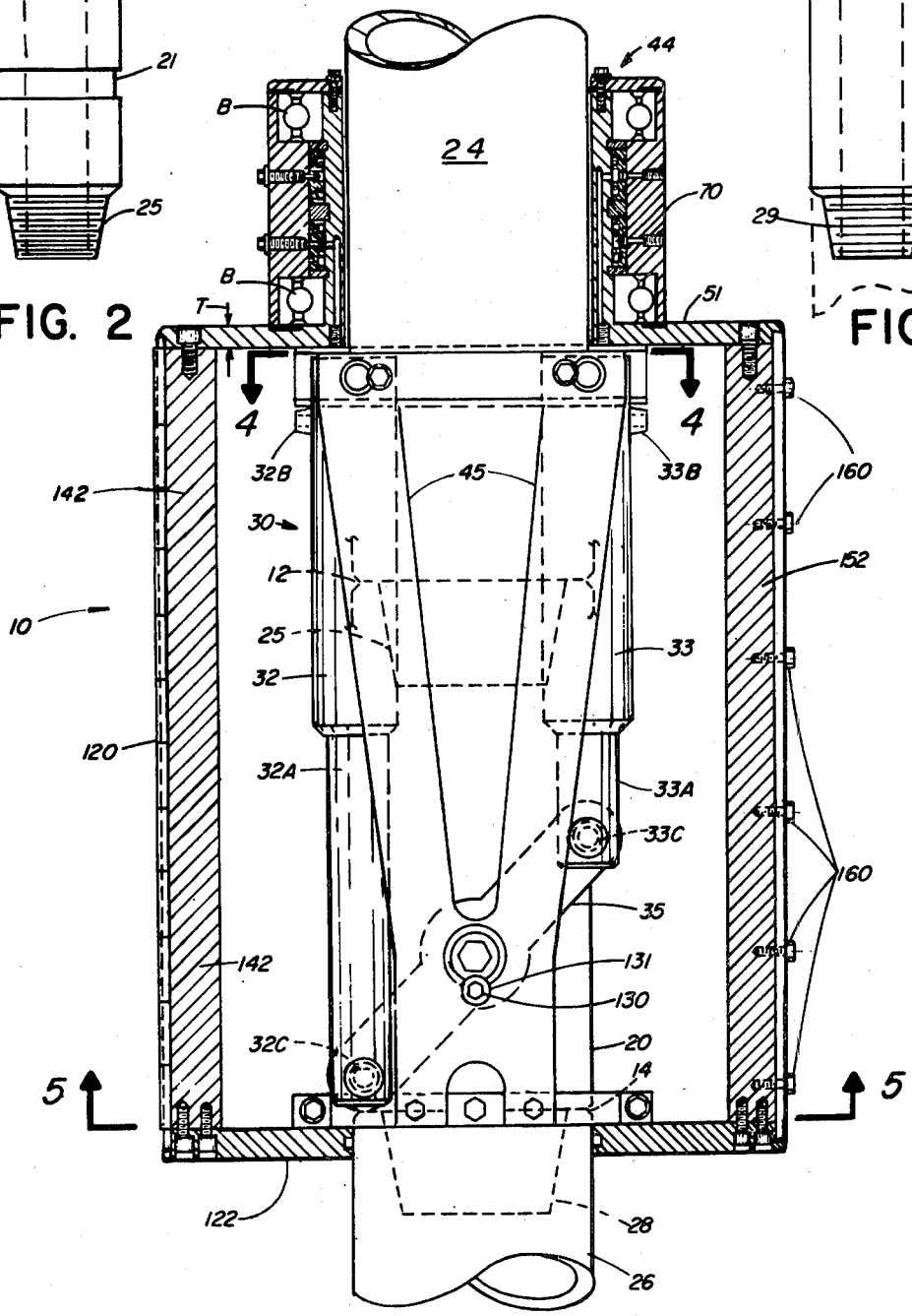
FIG. 1 is a front sectional view of the preferred embodiment of the apparatus of the present invention.

FIG. 1 best shows the preferred embodiment of the apparatus of the present invention designated generally by the numeral 10. Kelly valving apparatus 10 provides a kelly valve 20 having an operator assembly 30 which as will be described more fully hereinafter moves the valve between open flow and closed flow positions which respectively allow fluid flow through the kelly valve bore 11 between the upper sub 24 and lower sub 26 and in the closed flow position shut off flow though the bore. Operator assembly 30 in the preferred embodiment provides a hydraulically powered operator with hydraulic fluid being dispensed in a pressurized fashion through collector ring assembly 44 to operator assembly 30.

As will be described more fully hereinafter, the kelly valving apparatus 10 of the present invention can be remotely operated as, for example, from the driller's panel on an oil and gas drilling rig without regard as to whether or not the kelly is spinning or static, using hydraulic fluid to power the operator.

The apparatus of the present invention thus provides an inside blowout preventor for oil and gas drilling rigs which can be quickly operated from a remote location in any drilling situation.

In FIG. 1 in the drawings there can be seen an upper sub 24 which connects at joint 12 with kelly valve 20 with a lower sub 26 attaching at the lowermost portion of kelly valve 20 at joint 14. Lower sub 26 would attach to the drilling kelly K with apparatus 10 valving flow of fluids through the kelly.

Kelly valve 20 is, for example, a conventional manually operated kelly cock which is commercially available. Presently, such devices are manually operated by use of an allen wrench or the like. This manual operation requires that a human operator or other personnel on the drilling platform climb or otherwise obtain access to the kelly cock and place the allen wrench in position and manually close the valve. Problems exist in that time may be of the essence and significant danger might be presented by an operator approaching the kelly cock to close it in a blowout situation where the entire rig may at any second be subject to explosion or fire.

Figure 2:
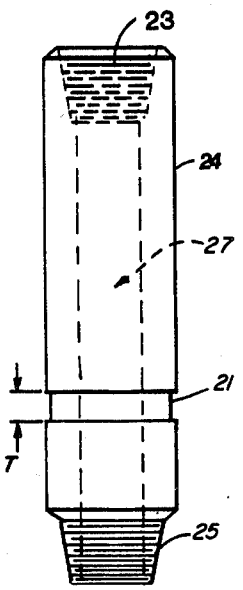
FIG. 2 is a front view of the upper sub portion of the preferred embodiment of the apparatus of the present invention.

Upper sub 24 is best seen in FIG. 2 and provides a length of drill pipe having, for example, a lower pin connection 25 and an upper box connection 23 with a uniform fluid conveying bore 27. An annular groove 21 is milled about the exterior of upper sub 24 being of a thickness T which corresponds to the thickness T of plate 51 as seen in FIG. 1. A threaded connection could be provided at groove 21 for disassembling sub 24 thus allowing it to be assembled to support plate 51 at groove 21. Plate 51 would provide a central opening having an inner diameter (I.D.) substantially equal to the outer diameter (O.D.) of sub 24 at groove 21.

Upper sub 24 connects to kelly cock 20 at joint 12 which is a box-pin type connection known in the oilfield drill pipe art.

Figure 3:
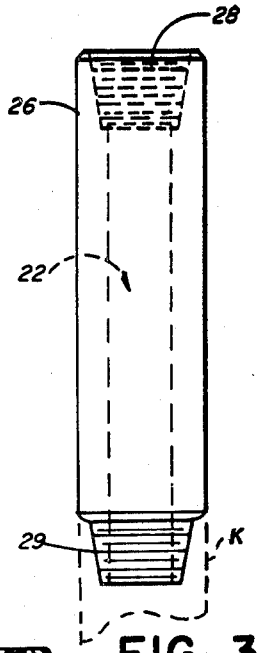
FIG. 3 is a front view of the lower sub portion of the preferred embodiment of the apparatus of the present invention.

The lowermost portion of kelly cock 20 provides a connection at joint 14 to lower sub 26. Lower sub 26 (FIG. 3) would have an upper box connectin 28 and a lower pin connection 29 with a pin connection provided on kelly cock 20 assembling to the box connection 28 of lower sub 26. The connection of upper sub 24 and lower sub 26 to kelly cock 20 is similar to the connections made with manual type kelly cocks in the oilfield. A bore 22 is also provided in lower sub 26. Kelly K attaches by pin and boxtype connections to sub 26.

FIG. 1, FIGS. 4–5, and FIGS. 10A–10B show operator assembly 30. Operator 30 is, for example, a hydraulically powered operator having connection through drive arm 35 to kelly cock 20. It should be understood that a provided hexagonal key 36 on drive arm 35 attaches to a provided hexagonal recess on kelly cock 20 which is receptive of key 36 and which thereafter is connected to a central valving member of kelly cock 20 which could be, for example, a ball valving member of the like as is the case in conventional kelly cocks.

It will be understood by one skilled in the art that once drive arm 35 and more particularly hexagonal key 36 mates with the provided socket on kelly cock 20, rotational movement thereafter of drive arm 35 will effect a rotation of the provided valving member of kelly cock 20 effecting an opening and closing of the kelly cock 20 valving member between open flow and closed flow positions. The provided socket is available on conventional manual kelly cocks and normally is manually operable by an allen wrench or like hand tool.

Left and right hydraulically operative cylinders 32, 33 will rotate drive arm 35 approximately 90 degrees between open flow positions and closed flow positions of kelly cock 20 responsive to alternate extensions of hydraulic cylinders 32, 33 and their provided rams 32A, 33A.

The opposite end of drive hex key 36 provides a drive sleeve 39 having an internal socket 40 which is hexagonal. This allows drive arm 35 to be manually operated as a backup, if desired, by the placement of a hexagonal allen wrench or the like hand tool into socket 40 and turning effected. Drive sleeve 39 on its outer surface would otherwise be rounded and would fit into a provided opening on yoke 45. Thus, drive arm 35 would be supported at the end portions of hex key 36 which would be anchored into the socket of kelly cock 20 and at its opposite end with sleeve 39 at shoulder 41 resting in and rotating within a provided opening on yoke 45. With the end portions being so supported, a rotational movement of drive arm can be achieved by sequential extensions of rams 32A. 33A.

Each ram 32A, 33A attaches at its end drive arm 35 at provided openings 37, 38 of drive arm 35. Pinned connections 32*c*, 33*c* are preferable as shown in FIGS. 1 and 5.

Support for operator 30 is achieved by bracing cylinders 32, 33 at their upper end portion and by supporting their lower end portion at drive arm 35 with, as aforementioned, drive arm 35 being supported by kelly cock 20 and at its other end by yoke 45. The end portions of yoke 45 are supported by a plurality of brackets which themselves attach to the cylindrical member formed by the connection of upper sub 24, kelly cock 20, and lower sub 26. The construction of the supporting brackets will now be discussed more fully.

Figure 4:
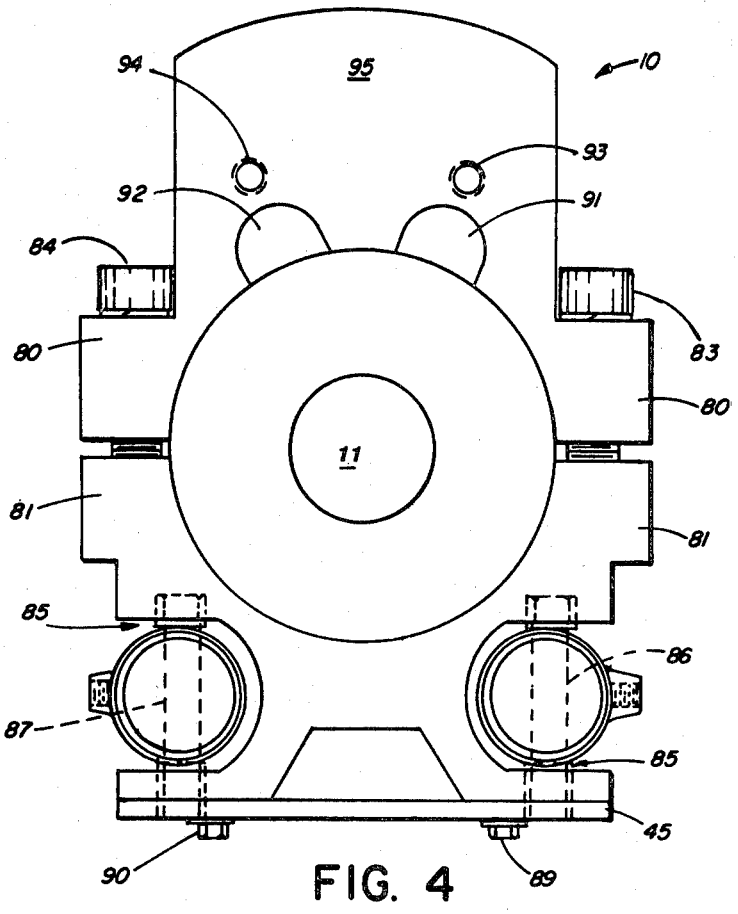
FIG. 4 is a sectional view taken along lines 4—4 of FIG. 1.
Figure 5:
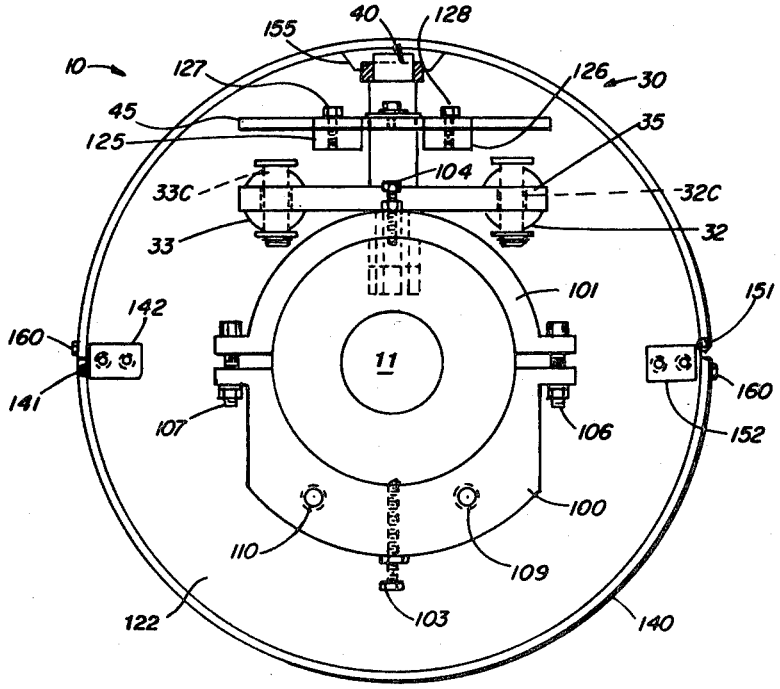
FIG. 5 is a sectional view taken along lines 5—5 of FIG. 1.
Figure 6:
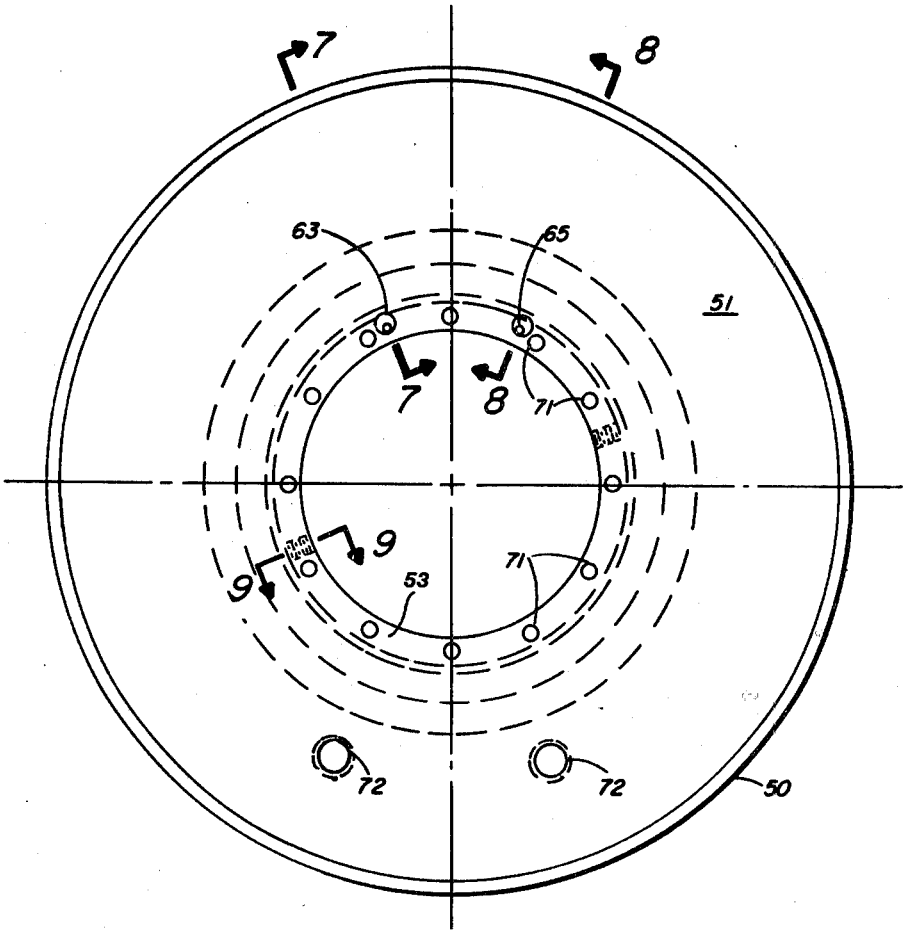
FIG. 6 is a top view of the upper housing base portion of the preferred embodiment of the apparatus of the present invention.

In FIGS. 4 and 5 there can be seen the inner bore 11 of kelly cock 20 and in these sectional views also the support of operator 30. Note in FIG. 4 a pair of upper support brackets 80, 81 which are connected together by structural bolts 83, 84. A pair of recesses 85 are formed on each side of support bracket 81 with pin connections 86, 87 being formed at recesses 85 to hold the upper end portions of cylinders 32, 33 in a supported fashion at bracket 81. Retainers 89, 90 in the form of a bolt and washer, for example, will be provided if desired to keep the pinned connections 86, 87 from disassembly during operation.

Openings 91, 92 which are generally semi-circular can be seen on bracket 80. These allow hydraulic hoses (not shown) to pass through openings 91, 92 and attach to collector ring assembly 44. The opposite end portion of the hoses (not shown) would connect respectively to the provided ports 32*b*, 33*b*.

Bracket 80 provides an enlarged portion 95 which could be weighted to act as a counterweight to the entire operator assembly 30 thus providing for a dynamically balanced apparatus 10 which would not impart excess or undesireable vibration to the drill string during rotation of the kelly.

Also seen on bracket 80 are openings 93, 94 which could provide inner threads. These openings 93, 94 would align with openings provided in plate 51 through which openings and the corresponding threaded openings of plate 50, attachment bolts would be connected. This would effect a vertical connection between bracket 80 and plate 50 discouraging slippage of brackets 80, 81 downwardly on the assembly of sub 24, kelly cock 20, and sub 26. The connection of bracket 80 to bracket 81 by structural bolts 83, 84 would also be a tight connection which would be assembled using torque so that a clamping effect would be achieved against upper sub 24 which would also enhance in discouraging vertical movement of brackets 80, 81 along the upper sub 24.

FIG. 5 shows a pair of lower brackets 100, 101 which are affixed to the joint 14 between kelly cock 20 and lower sub 26. A pair of bolts, for example, 103, 104 are attached to brackets 100, 101 respectively and provide conical tips which anchor brackets 100, 101 into the shown recess provided at joint 14. A further assembly of brackets 100, 101 to the assembly of kelly cock 20 and lower sub 26 is provided by structural bolts 106, 107 which assemble brackets 100, 101 together forming a bolted connection which could be torqued to provide a clamping effect of brackets 100, 101 and the provided bolts 106, 107 to the assembly of kelly cock 20 and lower sub 26.

A pair of openings 109, 110 on lower bracket 100 could be provided with inner threads which would allow a bolted connection to be formed between bracket 100 and cover assembly bottom plate 122. Also provided on bottom plate 122 of cover assembly 120 would be a pair of attachment blocks 125, 126 which could be attached thereto by welding, for example. Yoke 45 would be attached by bolting, for example, to blocks 125, 126 with the bolts shown in FIGS. 1 and 5 as 127, 128 respectively.

A retainer bolt 120 and washer 131 are provided for retaining key 36 and drive arm 35 in their lateral position so that movement outwardly is not possible. Bolt 130 would be threadably anchored in yoke 45 with washer 131 overlapping the end sleeve 39 at recess 40. Note from an inspection of FIG. 10A that a reduced diameter to sleeve 39 is indicated as shoulder 41 in FIG. 10A. This reduced diameter would be the position occupied by an opening of substantially the same diameter as shoulder 41 in yoke 45.

The construction of cover assembly 120 is best seen in FIGS. 1 and 5. Cover assembly 120 provides a pair of halves 140, 150, each of which is hingedly attached at a provided hinge 141, 151 which hinge is attached to by welding, for example, its respective strut support member 142, 152. Each of support struts 142, 152 is attached by bolting, for example, at its upper end portion to plate 51 and at its lower end portion to plate 122. These bolted connections are shown in FIGS. 1 and 2.

Each cover plate 140, 150 is attached opposite its hinge 141, 151 to the opposite provided strut support 142, 152 as shown in FIGS. 1 and 5 by a plurality of, for example, machine screws. These machine screws are indicated as 160 in FIG. 1. Disassembly of cover 120 can be achieved by merely removing the aforementioned bolts, first from struts 142, 152 and thereafter from plates 51, 122.

An opening is provided in cover plate 150 adjacent recess 40 which allows an allen wrench or like hand tool to be inserted therethrough for operation of recess 40 as aforementioned. A dust cover 155 which could be, for example, of rubber of the like would insure a dust-free environment within the confines of cover assembly 120.

FIGS. 1, 6–9 and 11–12 show with particularity the construction of collection ring assembly 44.

Figure 1A:
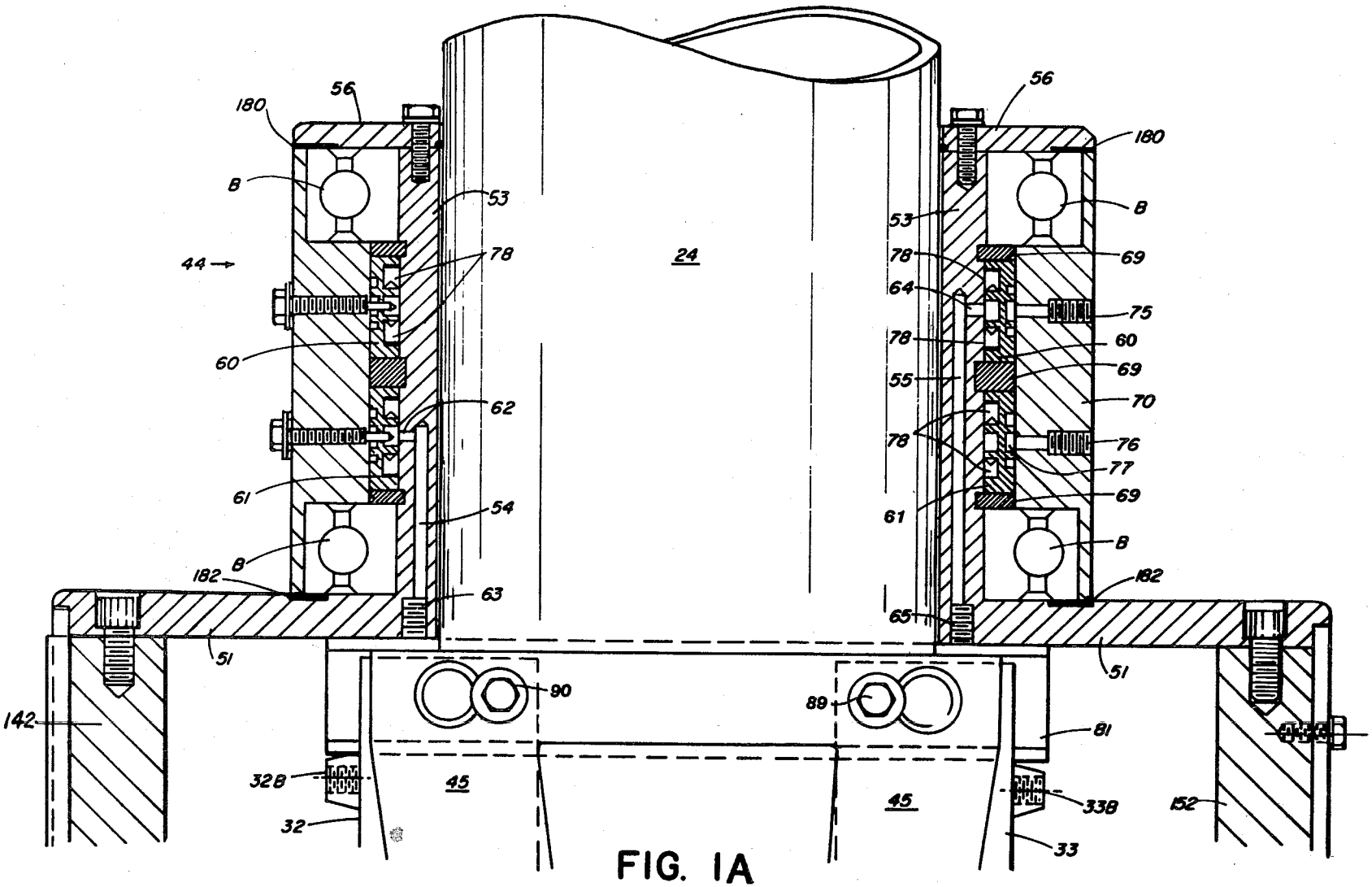
FIG. 1A is a front sectional view of the collection ring assembly portion of the preferred embodiment of the apparatus of the present invention.

In FIGS. 1–1A there can be seen with particularity the complete assembly of collector ring assembly 44.

Collector ring assembly 44 comprises generally a pair of collector seal holders 60, 61 carried between a collector ring upper housing 50, end cap 56 and an outer housing cylinder 70. Upper housing 50 comprises generally plate 51 and housing inner wall 53, the two of which can be integral (see FIGS. 7–9).

Figure 11:
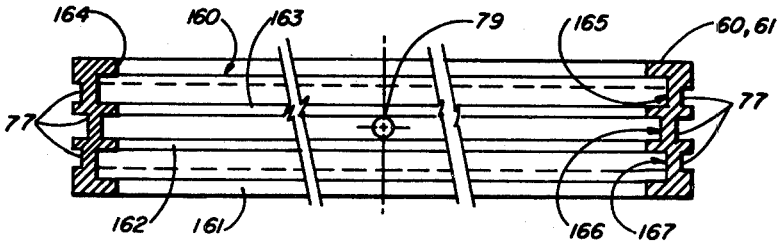
FIG. 11 is a front sectional view of the collector seal holder portion of the preferred embodiment of the apparatus of the present invention.
Figure 12:
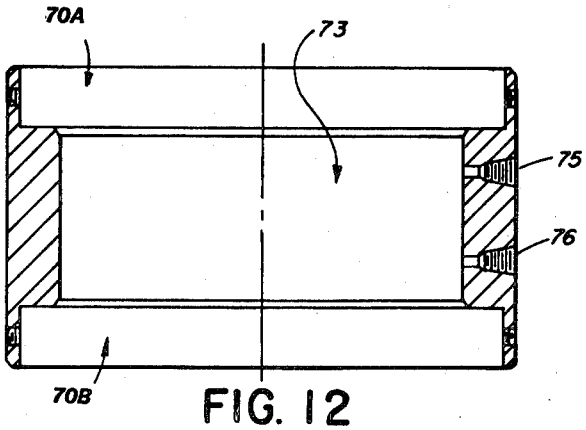
FIG. 12 is a sectional view of the upper housing cylinder portion of the preferred embodiment of the apparatus of the present invention.

FIGS. 6–9 show with particularity the construction of collector ring upper housing 50 while FIG. 11 shows more particularly the construction of each collector seal holders 60, 61; with FIG. 12 showing more particularly the construction of upper housing cylinder 70.

The construction of collector ring upper housing 50 will now be discussed more fully with respect to FIGS. 6–9.

Collector ring upper housing 50 provides a lower substantially flat plate portion 51 which connects to a collector housing inner wall 53. A central bore is provided which allows upper sub 24 to pass therethrough.

Figure 7:
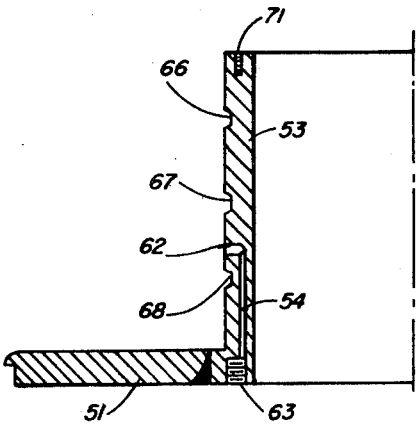
FIG. 7 is a sectional view taken along lines 7—7 of FIG. 6.
Figure 8:
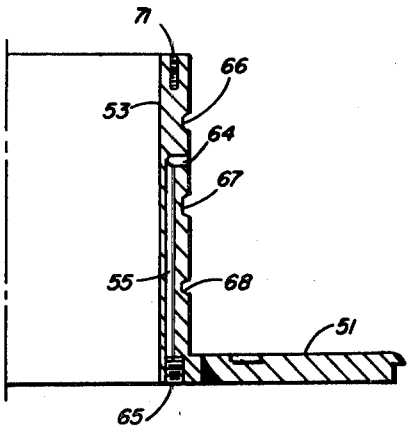
FIG. 8 is a sectional view taken along lines 8—8 of FIG. 6.
Figure 9:
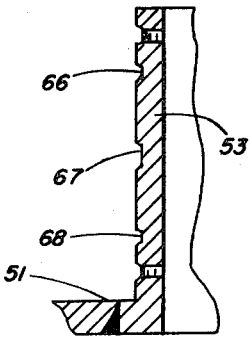
FIG. 9 is a sectional view taken along lines 9—9 of FIG. 6.
Figure 10A:
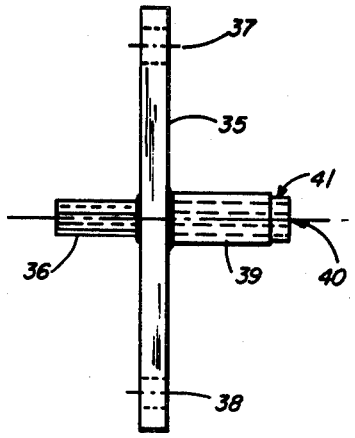
FIGS. 10A–10B are side and front views respectively of the drive arm portion of the preferred embodiment of the apparatus of the present invention.
Figure 10B:
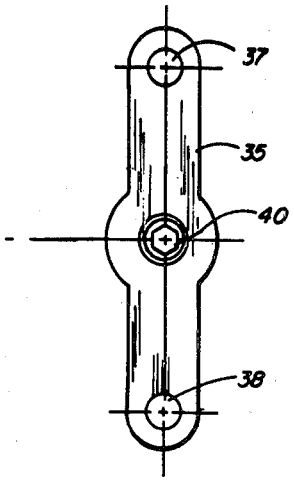

Wall 53 provides a pair of conduits 54, 55 which communicate respectively between provided ports. In FIG. 7, conduit 54 is shown being connected between port 62 and port 63 while conduit 55 connects at its end portions between port 64 and port 65.

Three annular grooves 66–68 are shown in wall 53 which are occupied by thrust rings 69 as being seen in FIG. 1A.

Upper threaded openings 71 allow for a threaded attachment of a bolt, for example, or like connector thereinto which allows assembly of end cap 56 to wall 53 of collector ring upper housing 50.

During operation fluid will flow from port 64 downwardly through conduit 55 to port 65. In a like manner, fluid will flow in operation from port 62 through conduit 54 to port 63. Ports 63, 65 will be attached by way of hydraulic hoses (not shown) to the provided ports **32*b*, 33*c* respectively provided upon hydraulic cylinders 32, 33**.

Threaded openings 72 provided on plate 51 have inner threads which allow a bolted connection to be formed of plate 51 to bracket 80. Similar openings 93, 94 as aforementioned are provided on bracket 80 which align with the threaded openings 72 of plate 51.

Fluid is supplied through hydraulic inlet ports 75, 76 of outer housing 70 to each collector seal holder 60, 61. This hydraulic connection can be seen best in FIG. 1A. The construction of each collector seal holder is seen best in FIG. 11. Each seal holder 60, 61 has a central bore 73 for passage of wall 53 therethrough and also provides three external annular grooves 77 with O-rings or like packing material normally occupying the upper and lowermost grooves. Four openings 79 are bored in the middle groove communicating with an inner chamber 160. Four inwardly projecting annular ribs 161–164 define therebetween three inner annular grooves 165–167. Packing material 78 would normally occupy grooves 165–167.

With respect to upper port 75, fluid flow would be provided thereto in the form of compressed hydraulic fluid which would be the operator fluid. Though hoses are not shown connected to ports 75, 76, it will be understood that hydraulic hoses would be attached thereto and extend to a remote location where the source of hydraulic fluid would be contained. These hoses would prevent rotation of outer housing cylinder 70. A backup such as a chain, for example, (not shown) could be attached to outer housing cylinder 70 at one end, and at its other end anchored to the drilling rig structure to further insure non-rotation of outer housing cylinder 70. Otherwise, the entire remaining assembly would rotate with bearings "B" within a provided bearing race providing an interface between housing cylinder 70 and collector ring upper housing 50.

The flow of hydraulic fluid from port 75 to its respective cylinder 32, 33 would be from port 75 through collector ring outer groove 77 through opening 79 to inner groove 166 and thence to port 64 of collector ring upper housing 50, through conduit 55 and then to port 65. From port 65, a flexible hydraulic hose (not shown) would convey fluid to the port 32*b* or 33*b* of the cylinder 32 or 33 which was desired to be operated from the hose connected to port 75.

A similar flow of operator fluid would be seen with regard to port 76. A provided hydraulic hose (not shown) would convey hydraulic fluid from a desired source under pressure to port 76 and thence through to outer groove 77 of collector seal holder 60, 61 thence through opening 79 (four of which are preferably provided), thence to inner groove 166, thence to port 62 of collector ring upper housing 50 and then through conduit 54 to port 63. In similar fashion, a hydraulic hose would connect to port 63 and then be connected at its opposite end to either cylinder 32 or 33 at its provided port 32*b*, 33*b*. In this fashion, one skilled in the art will recognize that fluid dispensed at port 75 would operate one cylinder while fluid dispensed at port 76 would operate the other cylinder and a rotational movement of drive arm 35 effected which would respectively open or close kelly cock 20. It will follow that such opening and closing of kelly cock 20 would be effected in either a static or spinning condition of the assembly of kelly cock 20, upper sub 24, and lower sub 26.

If desired, seals could be provided at points 180 between outer housing cylinder 70 and end cap 56. Seals 182 could also be provided between outer housing cylinder 70 and plate 51.

FIG. 12 shows more particularly the construction of outer housing cylinder 70 having ports 75, 76 which would preferably be threaded and allow the attachment of hydraulic hoses thereto. A central bore 73 allows the passage of upper sub 24 therethrough and further allows for sufficient thickness to accommodate between collector seal holders 60, 61 and collector ring upper housing 50. Enlarged recess portions of bore 73 are seen at 70A and 70B which allow for placement of bearing races housing bearings B between collector ring upper housing wall 53 and outer housing cylinder 70.

Figure 13:
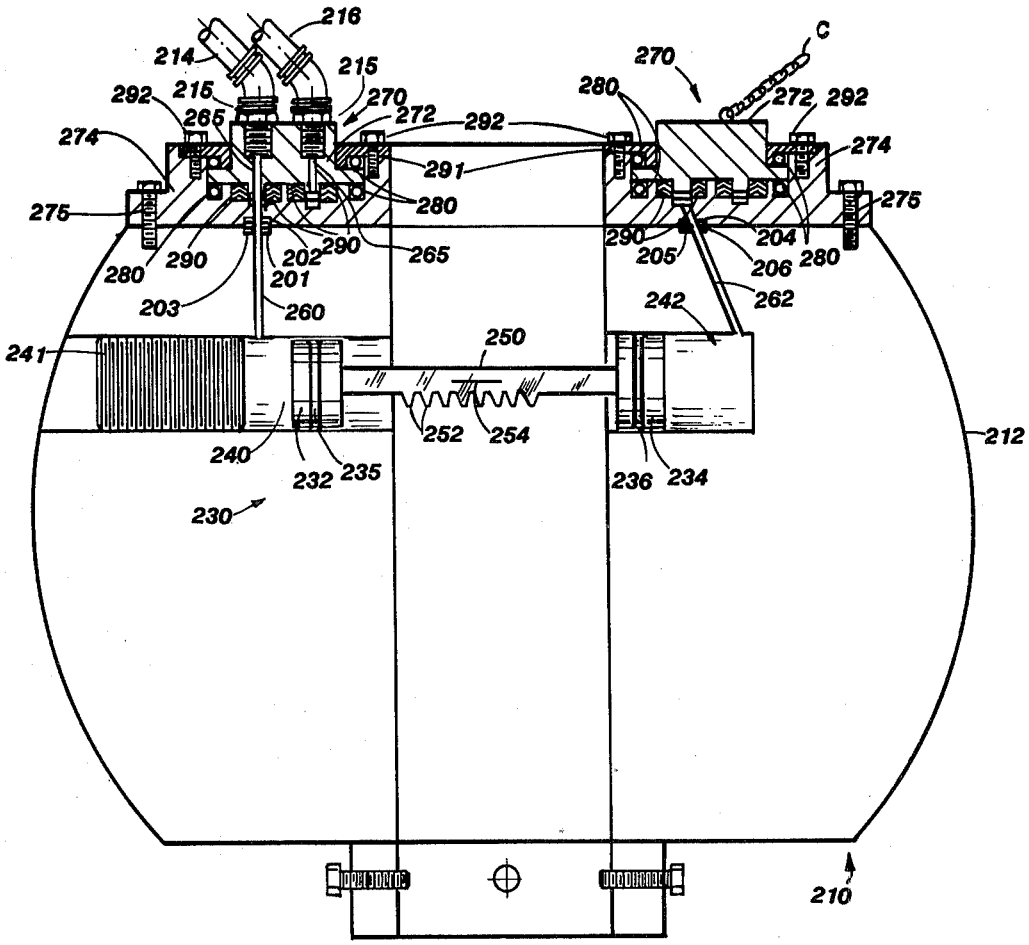
FIG. 13 is a sectional view of an alternate embodiment of the apparatus of the present invention.
Figure 14:
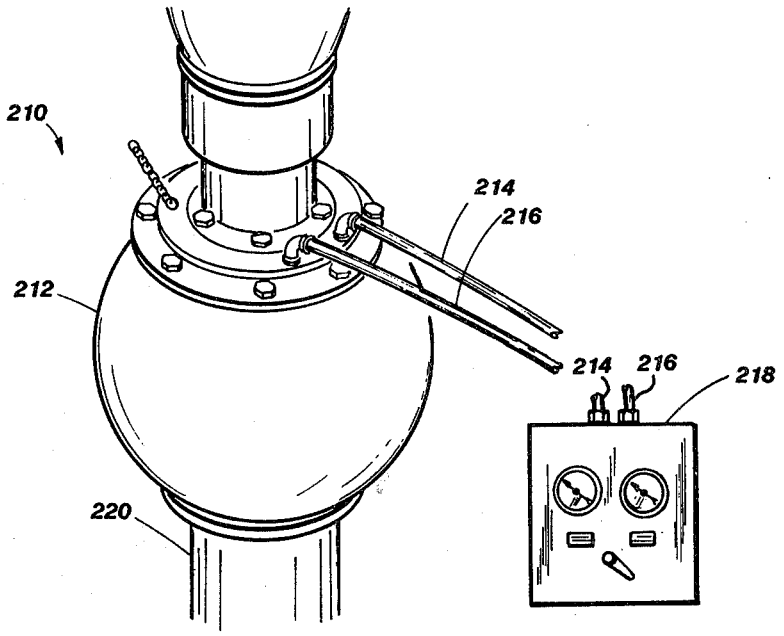
FIG. 14 is a perspective view of an alternate embodiment of the apparatus of the present invention.

FIGS. 13 and 14 illustrate another alternate embodiment of the apparatus of the present invention designated generally by the numeral 210.

Kelly valving apparatus 210 comprises generally valve body 212 attached to a conventional kelly 220 within which body 212 operator 230 is movably mounted. Attached to the upper portion of valve body 212 is collector ring 270 to which can be attached hydraulic fluid supply lines 214, 216.

Collector ring 270 comprises generally upper ring 272 and lower ring 274. It will be appreciated that upper ring 272 is movably mounted with respect to body 212 while lower ring 274 is attached rigidly to body 212 and moves therewith. A plurality of ball bearings 280 can be provided between upper and lower rings 272 and 274 with upper rings 272 being attached by means of brackets 29 through which suitable fasteners such as bolts 292 can be threadably affixed.

In FIG. 14 an overall schematic view of the kelly valve operator 210 of the present invention shows valve body 212 to which are attached fluid supply lines 214, 216 which cooperate with control panel 218 for valving the well kelly 220. Pressurized hydraulic fluid will be supplied to operate kelly valving apparatus 210 through control panel 218, lines 214, 216 and collector ring 270. Hoses 214, 216 as well as chain "C" prevent rotation of upper ring 272.

Provided at the inner portion of valve body 212 is valve member 225 which in the preferred embodiment is a spherical ball valve 225 having a flow opening (not shown) provided therethrough. It will be appreciated by one skilled in the art that operation of operator 230, a rack and pinion-type or similarly a Scotch yolk-type will rotate ball valve 225 between open flow and closed positions to achieve an open flow or closed flow status as is desired. In this manner, flow of drilling mud and the like can be valved at kelly.

Figure 15:
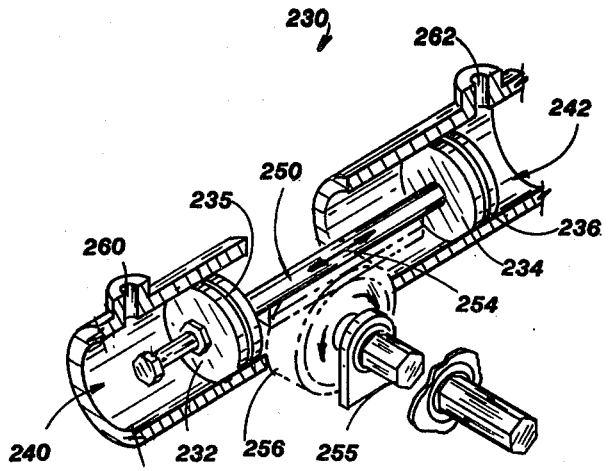
FIG. 15 is a perspective view of an alternate embodiment of the apparatus of the present invention illustrating the operator portion thereof.
Figure 16:
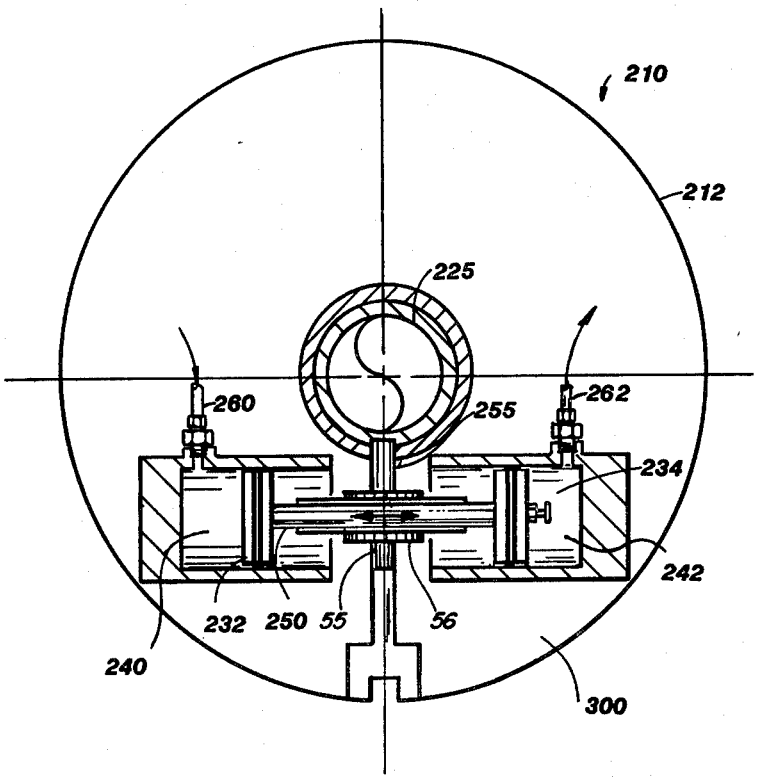
FIG. 16 is a top sectional view of an alternate embodiment of the apparatus of the present invention illustrating with particularity the valve and operator portions thereof.

Operator 230 as best seen in FIGS. 13 and 15–16 is hydraulic comprising a pair of drive pistons 232, 234 connected by rod 250. Rod 250 is provided with a plurality of teeth 252 and is operated by addition of pressurized hydraulic fluid into either inlet port 260 or inlet port 262 as the case may be.

Hydraulic fluid supply lines 214 will supply fluid through conduit 265 of upper rings 272 thence through outermost collector ring 203 formed by annular grooves 201, 203 into discharge ports 260 and into piston shaft 240.

In a like manner, inner fluid supply lines 216 will supply fluid through upper ring conduit 265 into innermost collector ring 204 formed by annular grooves 205 and 206 and thence into discharge port 262 into piston shaft 242.

The alternate introduction of hydraulic fluid in this manner to piston cyhamber 240 or to piston chamber 242 will move rod 250 in a slidable receiprocal fashion as illustrated by the arrow 254 in FIG. 13.

Rod 250 can be threaded with pistons 232, 234 being threadably mounted thereto, thus providing an adjustment of relative position of each piston 232, 234 upon rod 250. With such an adjustment, the volume of chambers 240, 242 can be changed.

Figure 17:
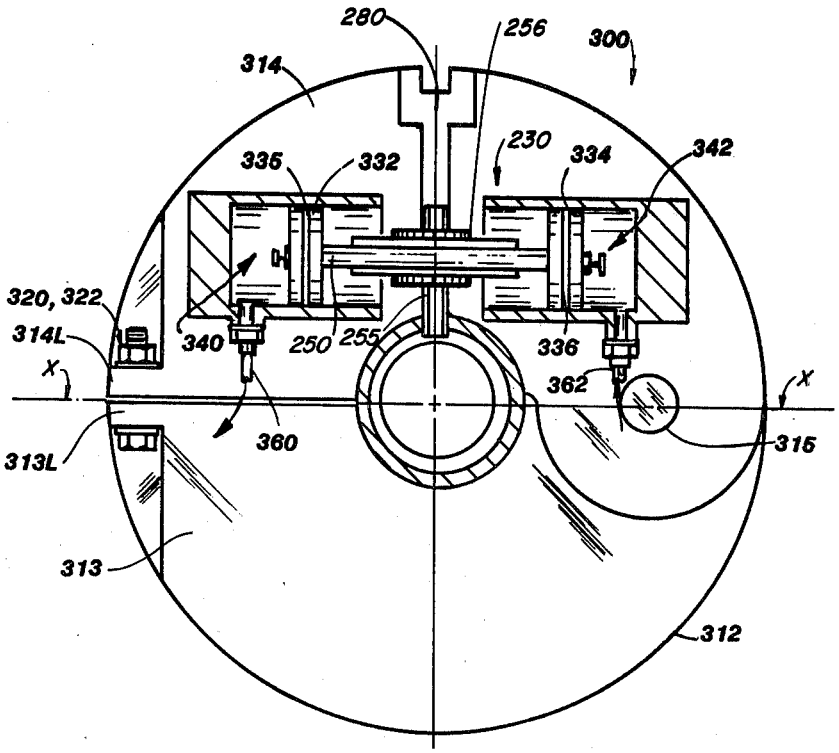
FIG. 17 is a top partial sectional view of an alternate embodiment of the apparatus of the present invention.
Figure 18:
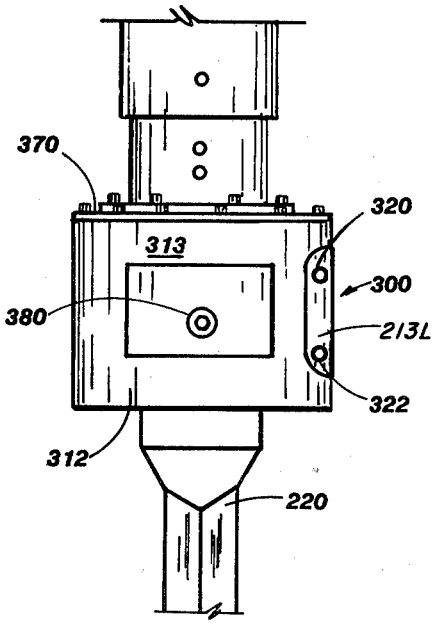
FIG. 18 is a side view of the embodiment of FIG. 17.
Figure 19:
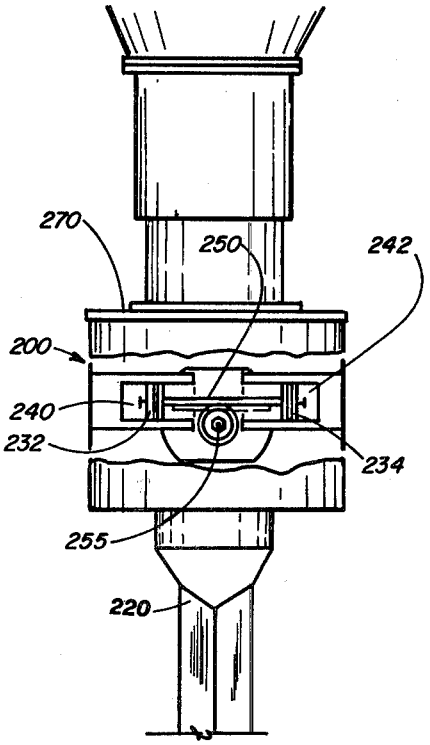
FIG. 19 is a side partially exposed view of the embodiment of FIGS. 17 and 18.

FIGS. 17–19 illustrate another alternative construction of the preferred embodiment of the apparatus of the present invention designated generally by the numeral 310. The apparatus of FIGS. 17–19 provides a removable kelly valving apparatus 310 which can be added to existing manually operable kelly cocks or kelly valves which are existing on operating kellys on operating oil and gas rigs. Removable valving apparatus 310 comprises generally valve body 312 which is a two-part valve body, having valve body halves 313, 314 as best seen in FIG. 17.

In FIG. 17 axis x-x shows a schematic line of division between halves 313, 314 intersecting hing pin 315.

Opposite hinge pin 315 is seen bolted connections 320, 322 which clamp together latches 313L, 314L.

As is the case with the preferred embodiment of FIGS.1–12, a collector ring 370 is provided at the uppermost portion of valve body 312, to which could be supplied the necessary hydraulic supply lines as was taught with respect to the preferred embodiment.

Hydraulic conduits 360, 362 are likewise provided for discharging pressurized hydraulic fluid into drive chambers 340, 342.

It should be understood that a rack and pinion operator 230 is shown in FIGS. 17–19. However, a Scotch yolk operator could also be utilized if so desired.

Pistons 332, 334 are sealably mounted at the end portions of rack 350 with rack 350 providing a plurality of teeth (not shown) with the pinion gear 256 engaging with rack 250. A similar arrangement is seen in FIG. 15 with respect to the preferred embodiment.

Seals 335, 336 can be provided respectively to pistons 332, 334 for forming a sealable connection of each piston 332, 334 with the inner walls respectively of drive chambers 340, 342.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A kelly valving apparatus for controlling flow of fluid through a kelly and drill string comprising:

a. a rotatable tubular section having a fluid conveying bore adapted to be attached to the drill string at the kelly;

b. valve means associated with said valve body for valving the flow of fluids through the bore;

c. remotely operable operator means rotatable with the rotatable tubular section, operably engaging the valve means for moving the valve means between positions which open and close the bore, the operator means including at least:

i. one hydraulic cylinder having an extensible ram actuated by hydraulic fluid;

ii. linkage means connecting the valve means and hydraulic cylinder so that extension/contraction of the ram effects an opening or closure of the bore;

d. a liquid interface fluid collector ring means positioned adjacent the rotatable tubular section for transmitting pressurized hydraulic fluid to the hydraulic cylinder, so that opening and closing of the valve means can occur during spinning of the cylinder, the tubular section, the collector ring means and the linkage means;

e. a source of controllable pressurized hydraulic fluid connectable to said fluid collector ring means for supplying pressurized hydraulic fluid thereto.

2. The apparatus of claim 1 wherein said valve means is a kelly cock.

3. The apparatus of claim 1 wherein said collector ring means comprises rotating and non-rotating housing portions, the source of pressurized fluid being connectable to said collector ring at the non-rotating housing portion thereof.

4. The apparatus of claim 1 wherein there are two expansible, hydraulic cylinders, each rotatable with the tubular section.

5. An automatic kelly valving apparatus for controlling flow of fluid through a kelly and drill string comprising:

a. a rotatable tubular section having an inner flow conveying bore;

b. valve means on said tubular section for valving the flow of fluids through said bore, said valve means being movable between an open flow position, allowing fluids to flow through said bore, and a closed flow position, stopping the flow of fluids through said bore;

c. remotely operable operator means carried and rotatable at least in part with the tubular section for operating said valve means with hydraulic power, said operator means comprising at least in part a drive linkage connected to said valve means and at least one expandable, hydraulic cylinder which rotates with the drive linkage and the tubular section for moving said linkage;

d. a source of hydraulically pressured fluid attachable to said operator means for powering said operator means to move said valve between said open flow and closed flow positions, said operator means being operable during a spinning or static position of said kelly; and e. liquid interface collector ring means positioned adjacent said valve body and comprising at least a rotating portion which is fixed for rotation with the tubular section and a non-rotating portion having a fluid inlet port, hydraulic fluid from the source of pressured fluid being dispensed to the cylinder through the collector ring.

6. The apparatus of claim 5, wherein said collector ring comprises rotating and non-rotating portions, at least one portion having an annular ring filled with fluid.

7. An automatic kelly valving apparatus for controlling flow of fluid through a drill string, comprising:

a. a rotatable tubular section having a flow passage formed therein adapted to be attached to the drill string;

b. flow passage closure means mounted with said rotatable tubular section for controlling flow of the fluid through said flow passage by movement of a flow controlling valve member to and from an open position for enabling flow of fluid through said flow passage, and a closed position for blocking flow of fluid through said flow passage;

c. remotely operable operator means rotatable with said rotatable tubular section, operably engaging said flow passage closure means for effecting desired flow controlling movement of said flow controlling valve member when actuated by hydraulic fluid, said operator means being operable during a spinning or static position of said kelly; and d. said operator means including:

i. at least one hydraulic cylinder having an extensible ram actuated by the hydraulic fluid; and ii. drive linkage means connecting the hydraulic cylinder and flow passage closure means for moving said flow controlling valve member to and from said open position and said closed position in response to extension of said extensible ram; and iii. a liquid interface collector ring assembly positioned adjacent said rotatable tubular section, comprising:

a stationary outer housing having a port to receive hydraulic fluid from a controllable source of hydraulically pressured fluid; and a rotatable inner wall fixed relative to said rotatable tubular section having means to communicate the hydraulic fluid from said outer housing to said operator means, whereby the hydraulic fluid communicated from said port in said stationary outer housing to said rotatable operator means actuates said rotatable operator means to controllably move said flow controlling valve member to and from said open position and said closed position effecting the desired flow control.

8. The invention of claim 7 further including seal means between the outer housing and the rotatable inner wall portions of the liquid collector ring assembly for preventing the loss of hydraulic fluid therefrom.

9. The invention of claim 7, wherein said liquid interface collector ring includes at least one annular groove defining a hydraulic fluid conveying cavity.

10. An automatic kelly valving apparatus for controlling flow of fluid through a drill string of the type including a rotatable tubular section having a flow passage formed therein and having flow passage closure means for controlling flow of the fluid through the flow passage by movement of a flow controlling valve member to and from an open position for enabling flow of fluid through said flow passage, and a closed position for blocking flow of fluid through said flow passage, the invention comprising:

a. a rotatable tubular section having a flow passage formed in said rotatable tubular section adapted to be attached to the drill string;

b. flow passage closure means mounted with the rotatable tubular section for controlling flow of the fluid through the flow passage by movement of a flow controlling valve member to and from an open position for enabling flow of fluid through the flow passage, and a closed position for blocking flow of fluid through the flow passage;

c. remotely operable operator means rotatable with the rotatable tubular section, operably engaging the flow passage closure means for effecting desired flow controlling movement of the flow controlling valve member when actuated by hydraulic fluid, said operator means being operable during a spinning or static position of said kelly;

d. the operator means including at least one hydraulic cylinder having an extensible ram actuated by the hydraulic fluid, and drive linkage means operably connected to the flow passage closure means for moving the flow of controlling valve member to and from the open position and the closed position in response to extension of the extensible ram; and e. a liquid interface collector ring assembly positioned adjacent the rotatable tubular section, compring i. a stationary outer housing having a port to receive hydraulic fluid from a controllable source of hydraulically pressured fluid; and ii. a rotatable inner wall fixed relative to the rotatable tubular section and the rotatable operator means, having hydraulic fluid conduit means to communicate the hydraulic fluid from the stationary outer housing to said rotatable operator means, whereby the hydraulic fluid communicated from said port in said stationary outer housing to said rotatable operator means actuates said rotatable operator means to controllably move the flow controlling valve member to and from the open position and the closed position effecting the desired flow control.

* * * * *